US008469755B2

(12) United States Patent
Gallato et al.

(10) Patent No.: US 8,469,755 B2
(45) Date of Patent: Jun. 25, 2013

(54) DRIVE ARRANGEMENT FOR AN INBOARD-OUTBOARD DRIVE ENGINE OF A WATERCRAFT

(75) Inventors: Fernando Gallato, Padua (IT); Adone Bertolo, Padua (IT); Andrea Tognon, Padua (IT)

(73) Assignee: ZF Friedrichshafen, AG, Friedrichshafen (DE)

( * ) Notice: Subject to any disclaimer, the term of this patent is extended or adjusted under 35 U.S.C. 154(b) by 131 days.

(21) Appl. No.: 13/130,332

(22) PCT Filed: Feb. 11, 2010

(86) PCT No.: PCT/EP2010/051700

§ 371 (c)(1),
(2), (4) Date: May 20, 2011

(87) PCT Pub. No.: WO2010/094614

PCT Pub. Date: Aug. 26, 2010

(65) Prior Publication Data

US 2011/0294378 A1 Dec. 1, 2011

(30) Foreign Application Priority Data

Feb. 18, 2009 (DE) ..... 10 2009 000 996

(51) Int. Cl.
*B63H 23/36* (2006.01)

(52) U.S. Cl.
USPC ..... 440/112

(58) Field of Classification Search
USPC ..... 440/88 L, 88 R, 111, 112
See application file for complete search history.

(56) References Cited

U.S. PATENT DOCUMENTS

| | | | | |
|---|---|---|---|---|
| 4,236,478 | A * | 12/1980 | Mansson | 440/112 |
| 4,543,069 | A * | 9/1985 | Kobayashi | 440/112 |
| 4,678,439 | A | 7/1987 | Schlichthorst | |
| 5,141,203 | A | 8/1992 | Baker et al. | |
| 6,478,646 | B1 | 11/2002 | Fukuoka et al. | |
| 6,561,859 | B1 * | 5/2003 | Towner et al. | 440/112 |
| 7,118,434 | B2 | 10/2006 | Arvidsson et al. | |
| 2001/0030274 | A1 | 10/2001 | Corona-Bittick et al. | |

FOREIGN PATENT DOCUMENTS

| | | |
|---|---|---|
| DE | 69 37 931 | 4/1970 |
| DE | 34 26 333 A1 | 1/1986 |
| DE | 196 33 421 A1 | 2/1998 |
| DE | 100 11 939 A1 | 9/2001 |
| DE | 699 33 288 T2 | 4/2007 |
| GB | 1 569 661 | 6/1980 |
| JP | 57-172897 A | 10/1982 |
| JP | 60-81097 U | 6/1985 |
| WO | 03/093106 A1 | 11/2003 |

* cited by examiner

*Primary Examiner* — Lars A Olson
(74) *Attorney, Agent, or Firm* — Davis & Bujold, PLLC

(57) ABSTRACT

A drive arrangement for an inboard-outboard drive engine of a watercraft, comprising a drive unit (2) with an upper part (3) arranged in a hull (1) of the watercraft and a lower part (4) which projects through a sealed opening in the hull (1) into the surrounding water such that a drivetrain extends through the drive unit (2). At least one propeller is supported by the lower part (4) and can be driven by a motor coupled to drive the upper part (3). The upper part (3) is in contact with a carrier system which, by virtue of a plurality of supporting units (12A-12D), supports reaction forces and torques produced in the drive unit (2) in the longitudinal, transverse and vertical directions relative to the hull (1).

8 Claims, 3 Drawing Sheets

DRIVE ARRANGEMENT FOR AN INBOARD-OUTBOARD DRIVE ENGINE OF A WATERCRAFT

This application is a National Stage completion of PCT/EP2010/051700 filed Feb. 11, 2010, which claims priority from German patent application serial no. 10 2009 000 996.5 filed Feb. 18, 2009.

FIELD OF THE INVENTION

The invention concerns a drive arrangement for an inboard-outboard drive engine of a watercraft, comprising a drive unit with an upper part arranged in a hull of the watercraft, and a lower part which projects into the surrounding water through a sealed opening in the hull, such that a drivetrain extends through the drive unit, by reasons of which at least one propeller provided on the lower part can be driven by an engine located in the area of the upper part.

BACKGROUND OF THE INVENTION

In watercraft, in particular engine-driven speedboats, drive concepts are often used in which a drive engine of the watercraft is arranged inside the latter and is actively connected, via a drive unit in the area of the boat's hull, to one or more propellers. For this purpose the drive unit usually passes through an opening in the hull or rear transom of the boat's hull. Thus, with such arrangements powerful engines, including also alternative drive concepts, can be used.

From DE 699 33 288 T2 a drive arrangement for an inboard-outboard drive is known, in which a drive unit with an upper part arranged in the area of an engine and in a hull of the watercraft, and a lower part, is provided. The lower part projects through an opening in the hull into the surrounding water and has at its end a propeller which, when it rotates, propels the watercraft forward. To produce this rotation a drivetrain extends through the upper and lower part of the drive unit, by means of which rotary movement of the engine can be transmitted to the propeller by shafts and bevel gear assemblies. In addition two seals, one behind the other, are provided in order to effectively prevent the entry of water through the opening in the hull. Furthermore, the upper part of the drive unit is connected at an end remote from the engine to a rubber mounting that acts on one side which, while the watercraft is being propelled forward, transfers tilting movements about the transverse axis into the hull and damps them.

However, this drive arrangement of the prior art has the considerable disadvantage that reaction forces and torques in all other directions are not taken up by the rubber mounting acting on one side, but have to be absorbed by an engine mounting and by the seals. Now, both when the watercraft is moving round a curve and when it is moving in reverse, such tilting movements of the drive unit take place. As a result the seal between the drive unit and the hull has to be made more rigid in order to be able to absorb the loads and vibrations over a long time without problems, but this at the same time adversely affects its sealing properties. Furthermore, an engine mounting has to be made substantially more robust.

SUMMARY OF THE INVENTION

Accordingly, the purpose of the present invention is to provide a drive arrangement for an inboard-outboard drive engine of a watercraft, with which the sealing in the area of the hull and the mounting of the drive engine are not loaded by reaction forces and torques imposed by the drive unit when the watercraft is driven.

The invention is based on the technical principle that the upper part of the drive unit is in contact with a carrier system which, by virtue of a plurality of support units, supports reaction forces and torques imposed upon the drive unit in longitudinal, transverse and vertical directions relative to the hull when the watercraft is driven. Since by virtue of the carrier system and its supporting units all reaction forces and torques are absorbed directly and transferred to the hull of the watercraft, in the area of the opening in the hull the seal can be designed optimally in relation to its sealing function. Moreover, in this way the load on the drive engine mountings is substantially reduced.

In an embodiment of the invention the carrier system has at least four supporting units, each with at least one supporting element, the at least four supporting units being distributed uniformly around the upper part of the drive unit and connected to it. Thanks to the uniform arrangement, the reaction forces and torques occurring in each case and transferred by the drive unit into the arrangement can be absorbed reliably and with a small number of connection points. Moreover, in correspondence with the number of supporting elements used, each supporting unit can be adapted to the prevailing loads.

In a further development of the invention the supporting units are positioned in equal parts on the two sides of the drive unit and are on each side respectively connected to the upper part by a common carrier arm. Thanks to this measure, a type of mounting bed is formed and all the movements and vibrations of the drive unit are optimally absorbed.

In an advantageous embodiment of the invention the carrier arm is formed by hollow profiles each with a rectangular cross-section which, individually, are fixed to the upper part of the drive unit by means of a trapezoidal-like attachment. Such a design of the carrier arm results in high rigidity along with low weight. Furthermore, thanks to the trapezoidal-like attachments a strong and at the same time material-saving connection to the drive unit is achieved.

In a further development of the invention each of the carrier arms has transverse ribbing. Advantageously, the rigidity of the carrier arms can thereby be increased still more.

A design feature of the present invention is that each of the supporting elements is formed in the manner of a rubber mounting that acts on both sides. By designing the supporting elements in this way, depending on the elastomer material used the vibrations introduced can be optimally damped and movements can be absorbed by deformations of the rubber elements. Thanks to the two-sided action this can moreover be realized in a manner which is optimum in relation to structural fitting space.

In a further advantageous embodiment of the invention, a plate arrangement that supports the drive unit is provided in the opening of the hull, with a static seal between the plate arrangement and the hull and a flexible seal between the plate arrangement and the drive unit. This has the advantage that the drive unit, together with the flexible seal and the plate arrangement, can be set into the hull opening as an already pre-assembled unit during the construction of the watercraft so that only the static seal still has to be fitted between the plate arrangement and the hull. This reduces the assembly effort and complexity.

In a further development of the invention the lower part of the drive unit can be rotated relative to the upper part. Thanks to this measure, the direction of movement of the watercraft can be controlled by appropriate rotation of the lower part of the drive unit, which increases the maneuverability of the watercraft compared with conventional rudder steering.

In a further development of the invention two propellers are provided on the lower part of the drive unit, which rotate in opposite directions when the watercraft is driven. By virtue of the oppositely rotating propellers rotation losses can be eliminated and cavitation effects minimized. Furthermore, no undesired lateral forces are produced and the bigger blade area enables larger gear steps in the drive to be used.

BRIEF DESCRIPTION OF THE DRAWINGS

Below, further measures that improve the invention are indicated in more detail together with the description of a preferred embodiment of the invention, given with reference to the figures, which show.

DETAILED DESCRIPTION OF THE PREFERRED EMBODIMENTS

Figure 1:
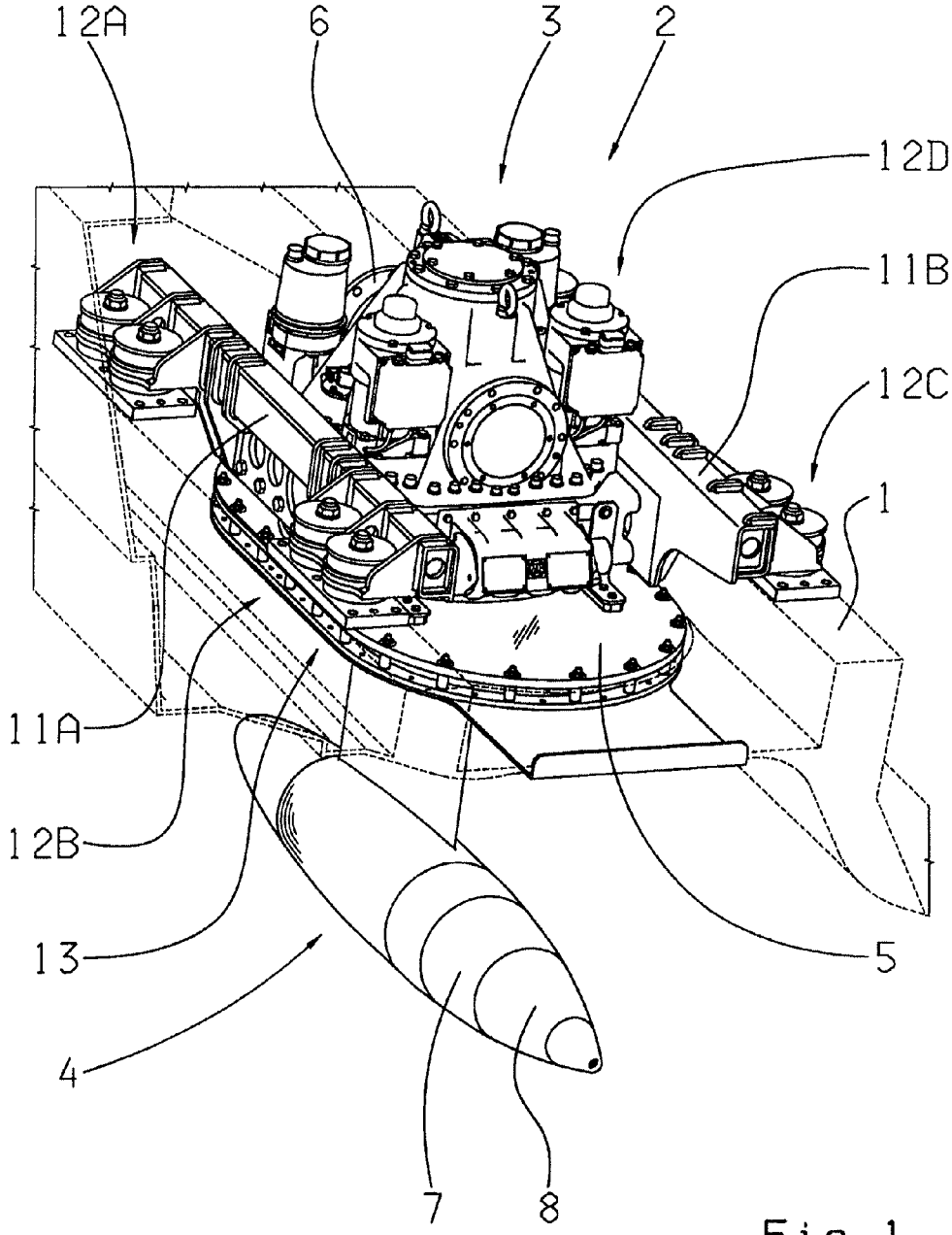
FIG. 1: Perspective view of the drive arrangement according to the invention, in the area of a hull of a watercraft.
Figure 2:
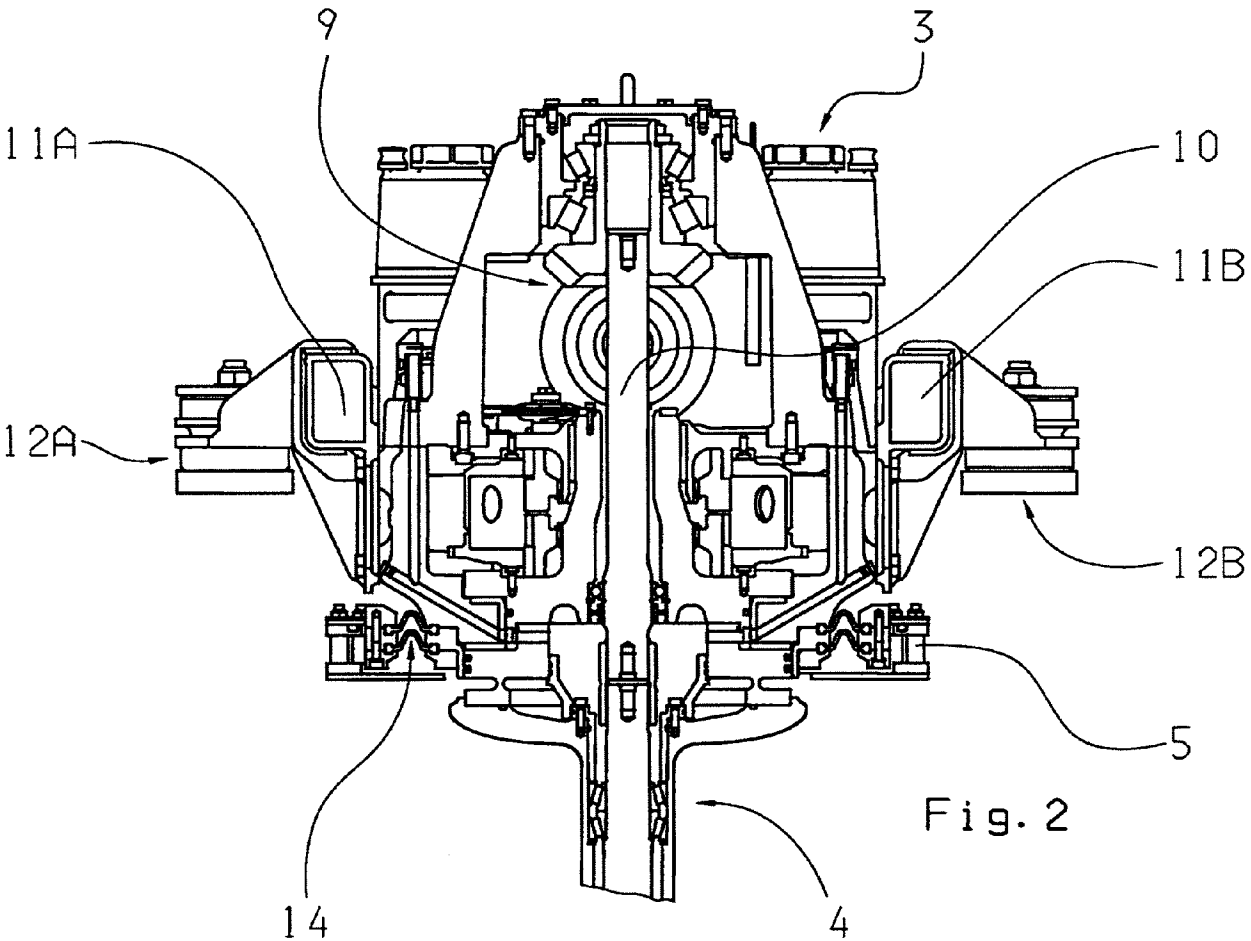
FIG. 2: Transversely sectioned view of an upper part of a drive unit of the drive arrangement according to the invention.

FIG. 1 shows a perspective view of the drive arrangement according to the invention, in the area of a hull 1 of a watercraft. This drive arrangement comprises a drive unit 2 consisting of an upper part 3 and a lower part 4, which is carried by a plate arrangement 5 in an opening of the hull 1. The upper part 3 of the drive unit 2 is arranged within the hull 1 and, in the longitudinal direction, is connected on one side to a motor (not shown here) of the watercraft by means of a flange 6 only partially visible in this view. Starting from the opening in the hull 1 the lower part 4 of the drive unit 2 projects into the water surrounding the watercraft and carries drive hubs 7 and 8 of two propellers (also not shown here). Rotational movement introduced by the flange 6 is transmitted within the drive unit 2 to the lower part 4 by a bevel gear transmission 9 (only visible in the side view shown in FIG. 2) of a drivetrain passing through the drive unit 2, by means of a vertically extending shaft 10. In the lower part 4, in a manner known to those familiar with the field, this rotation movement of the shaft 10 is converted by a further bevel gear transmission into opposite rotation movements of the two hubs 7 and 8. Furthermore, the lower part 4 of the drive unit can be rotated in a controlled manner relative to the upper part 3 and the hull 1, in order to steer the movement direction of the watercraft.

In order to absorb the reaction forces and torques produced when the watercraft is operated, in the longitudinal direction on both sides the upper part 3 of the drive unit 2 is in contact with carrier arms 11A and 11B at the ends of which respective supporting units 12A-12D connected to the hull 1 are provided. In combination with the two carrier arms 11A and 11B these supporting units 12A-12D form a type of mounting bed for the drive unit 2, whereby the reaction forces and torques can reliably be transmitted to the hull 1. Thanks to this arrangement there is almost no loading of the area around the plate arrangement 5, so that a static seal 13 between the hull 1 and the plate arrangement 5 and a flexible seal 14, which can only be seen in FIG. 2, between the plate arrangement 5 and the drive unit 2, can be designed optimally in relation to their sealing properties.

Figure 3:
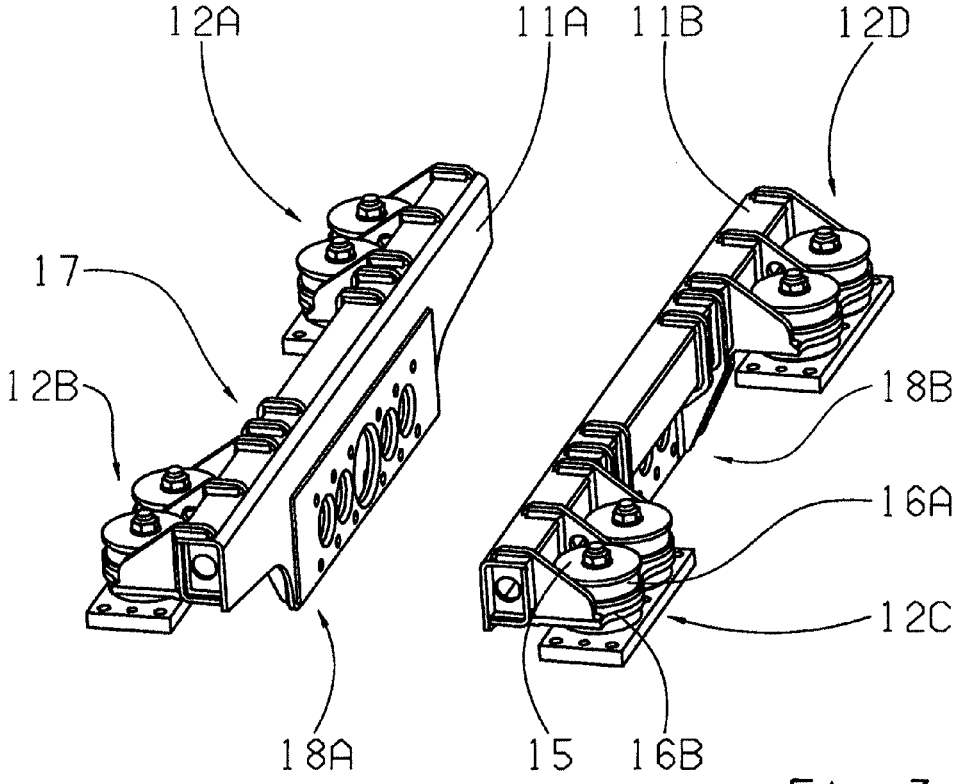
FIG. 3: Perspective view of a carrier system with supporting units of the drive arrangement according to the invention.

FIG. 3 shows a detailed perspective view of the carrier arms 11A and 11B together with the supporting units 12A-12D. As can be seen, each of the supporting units 12A-12D has two supporting elements, each of them in the form of a rubber mounting 15 acting on two sides. Each rubber mounting 15 is connected in the middle to its respective carrier arm 11A or 11B and absorbs its respective movement by virtue of rubber pads 16A and 16B arranged on the two sides and in a sandwich configuration. Furthermore, the rubber mounting is supported against the hull 1 (not shown here).

Figure 4:
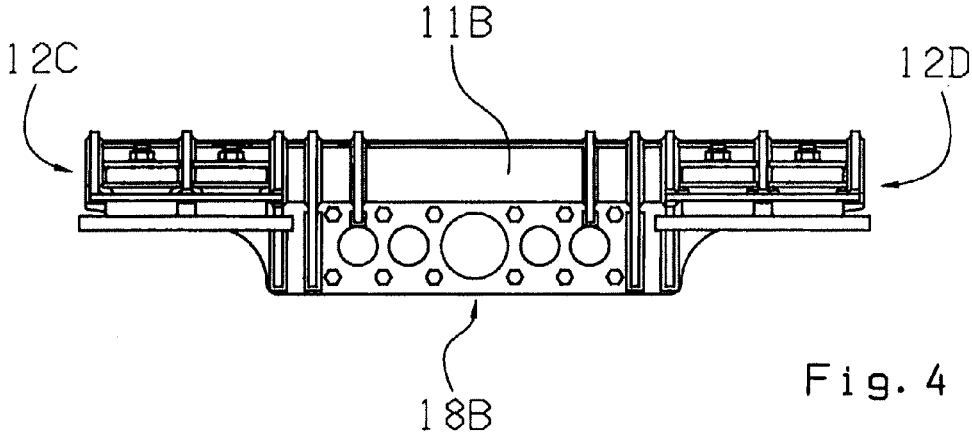
FIG. 4: Side view of the carrier system in FIG. 3.

As can also be seen in FIG. 3, the carrier arms 11A and 11B each have a rectangular cross-section and are provided on their outward-facing sides with transverse ribs 17 to increase rigidity. On the other hand, on their inner sides each has a trapezoidal-like attachment 18A and 18B, whose shape can be seen particularly clearly in FIG. 4 and which form in each case the fixing faces for connection to the drive unit 2 (not shown here). The trapezoidal-like shape improves the rigidity of the respective carrier arm 11A or 11B in this area.

By virtue of the design according to the invention, of a drive arrangement for an inboard-outboard drive engine of a watercraft, it is accordingly possible to design the seals 13 and 14 between the drive unit 2 and the hull 1 optimally as regards their sealing properties, and further, to relieve the load on the mountings of an engine connected thereto. Furthermore, even when the lower part 4 of the drive unit 2 is positioned obliquely in order to drive the watercraft in a curved path, the reaction forces and torques then occurring and which act not only in the longitudinal direction can be reliably absorbed and transferred into the hull 1. Finally, thanks to the arrangement of the supporting units 12A-12D and the design of their respectively associated supporting elements as rubber mountings 15, vibrations of the drive unit 2 are also reliably damped.

INDEXES

1 Hull
2 Drive unit
3 Upper part of the drive unit
4 Lower part of the drive unit
5 Plate arrangement
6 Flange
7 Drive hub
8 Drive hub
9 Bevel gear transmission
10 Shaft
11A, 11B Carrier arms
12A-12D Support units
13 Static seal
14 Flexible seal
15 Rubber mounting
16A, 16B Rubber pads
17 Transverse ribbing
18A, 18B Trapezium-like carrier arm attachments

The invention claimed is:

1. A drive arrangement for an inboard-outboard drive engine of a watercraft, the drive arrangement comprising:

a drive unit (2) with an upper part (3) arranged in a hull (1) of the watercraft and a lower part (4) which extends through a sealed opening in the hull (1) into surrounding water such that a drivetrain extends through the drive unit (2), by which at least one propeller, supported by the lower part (4), can be driven by a motor coupled to the upper part (3), the upper part (3) being in contact with a carrier system which, by virtue of a plurality of supporting units (12A-

12D), supports reaction forces and torques produced in the drive unit (2) in a longitudinal transverse direction and a vertical direction relative to the hull (1), the carrier system comprising at least four supporting units (12A-12D), each with at least one supporting element, and the at least four supporting units (12A-12D) being positioned uniformly around the upper part (3) of the drive unit (2) and connected thereto, and the at least four supporting units (12A-12D) being positioned in equal numbers on two sides of the upper part (3) of the drive unit (2) and each of the two sides are, in each case, connected to the upper part (3), via a respective common carrier arm (11A, 11B), the carrier arms (11A, 11B) comprising, in each case, a hollow profile with a rectangular cross-section and being, in each case, fixed to the upper part (3) via a attachment (18A, 18B).

2. The drive arrangement according to claim 1, wherein the carrier arms (11A, 11B) are provided with transverse ribs (17).

3. The drive arrangement according to claim 1, wherein each supporting element is a rubber mounting (15) that acts on two sides.

4. The drive arrangement according to claim 1, wherein a plate arrangement (5) is provided in the opening of the hull (1), which carries the drive unit (2), and a static seal (13) is provided between the plate arrangement (5) and the hull (1) and a flexible seal (14) is provided between the plate arrangement (5) and the drive unit (2).

5. The drive arrangement according to claim 1, wherein the lower part (4) of the drive unit (2) is rotatable relative to the upper part (3).

6. The drive arrangement according to claim 1, wherein two propellers are supported by the lower part (4) of the drive unit (2), and the two propellers rotate in opposite directions during drive of the watercraft.

7. An engine-driven watercraft comprising at least one drive arrangement comprising:

a drive unit (2) with an upper part (3) arranged in a hull (1) of the watercraft and a lower part (4) extending through a sealed opening in the hull (1) into surrounding water such that a drivetrain extends through the drive unit (2), by which at least one propeller supported by the lower part (4) can be driven by a motor coupled to the upper part (3), the upper part (3) being in contact with a carrier system which, by virtue of a plurality of supporting units (12A-12D), supports a reaction force and a torque produced in the drive unit (2) in a longitudinal transverse direction and a vertical direction relative to the hull (1), the carrier system comprises at least four supporting units (12A-12D), each with at least one supporting element, and the at least four supporting units (12A-12D) being positioned uniformly around the upper part (3) of the drive unit (2) and connected thereto, and the at least four supporting units (12A-12D) being positioned on opposed sides of the upper part (3) of the drive unit (2) and, each of the two sides are, in each case, connected to the upper part (3) via a respective common carrier arm (11A, 11B), the carrier arms (11A, 11B) comprising, in each case, a hollow profile with a rectangular cross-section and being, in each case, fixed to the upper part (3) via a trapezoidal attachment (18A, 18B).

8. A drive arrangement for an inboard-outboard drive engine of a watercraft, the drive arrangement comprising a drive unit (2) with an upper part (3) supported within a hull (1) of the watercraft and a lower part (4) extending through a sealed opening in the hull (1) to an exterior of the watercraft such that drive, from a motor, flows through the upper part (3) of the drive unit (2) to the lower part (4) of the drive unit (2) and to at least one propeller, supported on the lower part (4) of the drive unit (2), the upper part (3) of the drive unit (2) being supported on the hull (1) by at least four supporting units (12A-12D), which support a reaction force and a torque produced by the drive unit (2) in a longitudinal, transverse direction and a vertical direction relative to the hull (1), the at least four supporting units (12A-12D) are positioned uniformly about the upper part (3) of the drive unit (2) between the upper part (3) of the drive unit (2) and the hull (1), a carrier arm (11A, 11B) being located on opposite transverse sides of the drive unit (2), and the carrier arms (11A, 11B) comprise a hollow profile with a rectangular cross-section, the carrier arms (11A, 11B) are fixed to the upper part (3) of the drive unit (2) via a trapezoidal attachment (18A, 18B), and two of the four supporting units (12A-12D) are fixed to the hull (1) and support opposite ends of the respective carrier arm (11A, 11B).

* * * * *